US006929451B2

(12) United States Patent
Gregg et al.

(10) Patent No.: US 6,929,451 B2
(45) Date of Patent: Aug. 16, 2005

(54) COOLED ROTOR BLADE WITH VIBRATION DAMPING DEVICE

(75) Inventors: Shawn J. Gregg, Wethersfield, CT (US); Dominic J. Mongillo, Jr., West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 26 days.

(21) Appl. No.: 10/741,106

(22) Filed: Dec. 19, 2003

(65) Prior Publication Data

US 2005/0135933 A1 Jun. 23, 2005

(51) Int. Cl.[7] ..... F01D 5/10
(52) U.S. Cl. ..... 416/96 R; 416/97 R; 416/500
(58) Field of Search ..... 415/115, 119; 416/96 R, 416/97 R, 500, 193 A

(56) References Cited

U.S. PATENT DOCUMENTS 2,848,192 A * 8/1958 Hayes ..... 416/90 R
5,558,497 A 9/1996 Kraft et al.
5,820,343 A 10/1998 Kraft et al.
6,402,470 B1 6/2002 Kvasnak et al.

* cited by examiner

*Primary Examiner*—Ninh H. Nguyen
(74) *Attorney, Agent, or Firm*—McCormick, Paulding & Huber LLP

(57) ABSTRACT

A rotor blade for a rotor assembly is provided that includes a root, an airfoil, and a damper. The airfoil includes a base, a tip, a pressure side wall, a suction side wall, and a cavity disposed therebetween. The cavity extends substantially between the base and the tip, and includes a first cavity portion, a second cavity portion, and a channel disposed between the first cavity portion and the second cavity portion. A plurality of first pedestals are disposed within the first cavity portion adjacent the channel, and a plurality of second pedestals are disposed within the second cavity portion adjacent the channel. The damper is selectively received within the channel.

15 Claims, 3 Drawing Sheets

FIG.6
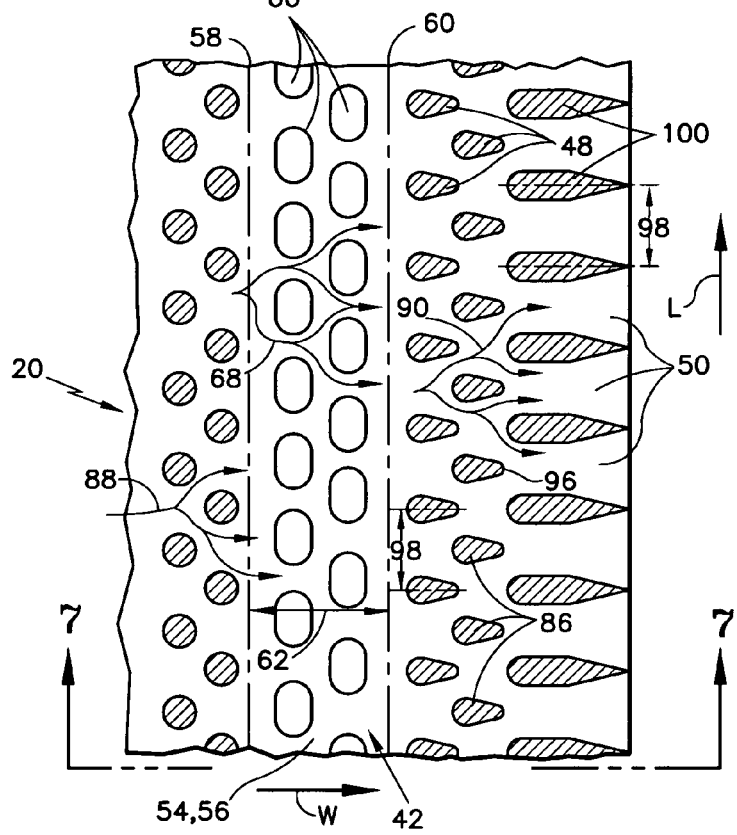
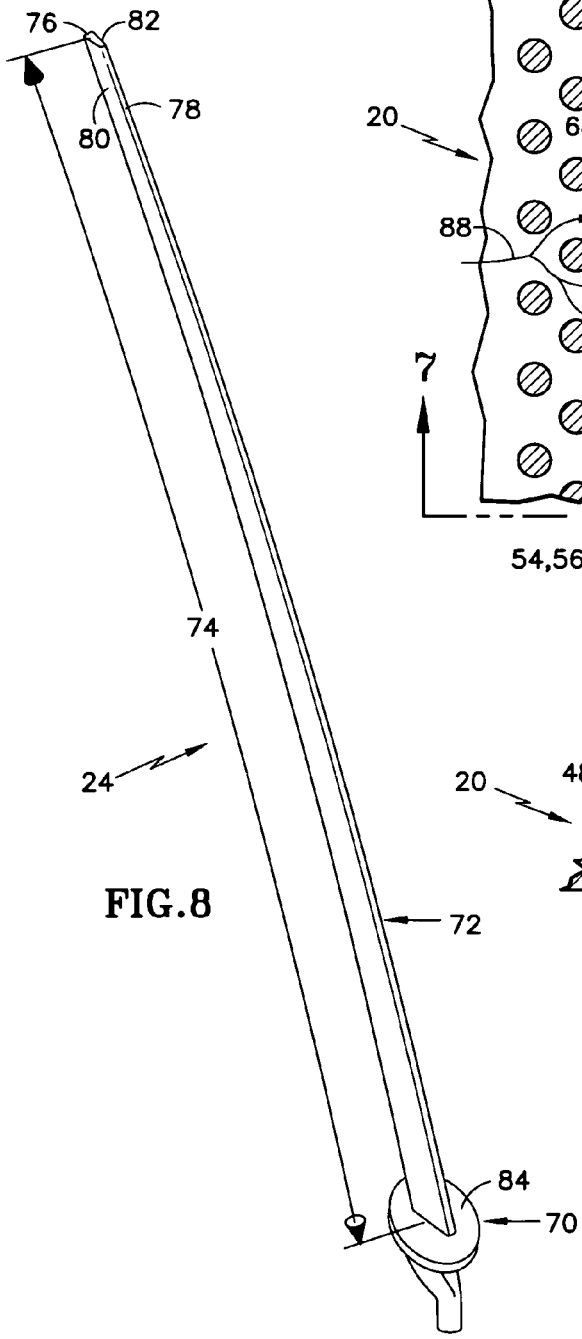
FIG.8
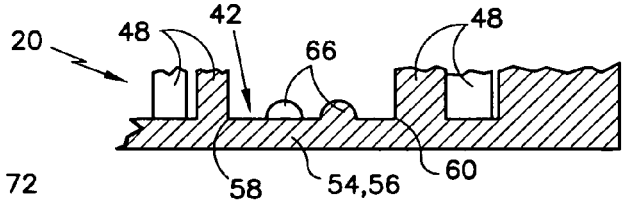
FIG.7

COOLED ROTOR BLADE WITH VIBRATION DAMPING DEVICE

The invention was made under a U.S. Government contract and the Government has rights herein.

BACKGROUND OF THE INVENTION

1. Technical Field

This invention applies to rotor blades in general, and to apparatus for damping vibration within and cooling of a rotor blade in particular.

2. Background Information

Turbine and compressor sections within an axial flow turbine engine generally include a rotor assembly comprising a rotating disc and a plurality of rotor blades circumferentially disposed around the disk. Each rotor blade includes a root, an airfoil, and a platform positioned in the transition area between the root and the airfoil. The roots of the blades are received in complementary shaped recesses within the disk. The platforms of the blades extend laterally outward and collectively form a flow path for fluid passing through the rotor stage. The forward edge of each blade is generally referred to as the leading edge and the aft edge as the trailing edge. Forward is defined as being upstream of aft in the gas flow through the engine.

During operation, blades may be excited into vibration by a number of different forcing functions. Variations in gas temperature, pressure, and/or density, for example, can excite vibrations throughout the rotor assembly, especially within the blade airfoils. Gas exiting upstream turbine and/or compressor sections in a periodic, or "pulsating", manner can also excite undesirable vibrations. Left unchecked, vibration can cause blades to fatigue prematurely and consequently decrease the life cycle of the blades.

It is known that friction between a damper and a blade may be used as a means to damp vibrational motion of a blade.

One known method for producing the aforesaid desired frictional damping is to insert a long narrow damper (sometimes referred to as a "stick" damper) within a turbine blade. During operation, the damper is loaded against an internal contact surface(s) within the turbine blade to dissipate vibrational energy. One of the problems with stick dampers is that they create a cooling airflow impediment within the turbine blade. A person of skill in the art will recognize the importance of proper cooling air distribution within a turbine blade. To mitigate the blockage caused by the stick damper, some stick dampers include widthwise (i.e., substantially axially) extending passages disposed within their contact surfaces to permit the passage of cooling air between the damper and the contact surface of the blade. Although these passages do mitigate the blockage caused by the damper to some extent, they only permit localized cooling at discrete positions. The contact areas between the passages remain uncooled, and therefore have a decreased capacity to withstand thermal degradation. Another problem with machining or otherwise creating passages within a stick damper is that the passages create undesirable stress concentrations that decrease the stick damper's low cycle fatigue capability.

In short, what is needed is a rotor blade having a vibration damping device that is effective in damping vibrations within the blade and that enables effective cooling of itself and the surrounding area within the blade.

DISCLOSURE OF THE INVENTION

It is, therefore, an object of the present invention to provide a rotor blade for a rotor assembly that includes means for effectively damping vibration within that blade.

It is still another object of the present invention to provide means for damping vibration that enables effective cooling of itself and the surrounding area within the blade.

According to the present invention, a rotor blade for a rotor assembly is provided that includes a root, an airfoil, and a damper. The airfoil includes a base, a tip, a pressure side wall, a suction side wall, and a cavity disposed therebetween. The cavity extends substantially between the base and the tip, and includes a first cavity portion, a second cavity portion, and a channel disposed between the first cavity portion and the second cavity portion. A plurality of first pedestals are disposed within the first cavity portion adjacent the channel, and a plurality of second pedestals are disposed within the second cavity portion adjacent the channel. The damper is selectively received within the channel.

An advantage of the present invention is that a more uniform dispersion of cooling air is enabled upstream of the damper, between the damper and the airfoil walls, and aft of the damper than is possible with the prior art of which we are aware. The more uniform dispersion of cooling air decreases the chance that thermal degradation will occur in the damper or the area of the airfoil proximate the damper.

Another advantage of the present invention is that a channel for receiving a damper that facilitates insertion of the damper within the airfoil, without creating undesirable cooling airflow impediments. Walls used as guide surfaces adjacent the channel either prevent the floe of cooling air or inhibit its distribution. In either case, the ability to cool the rotor blade is negatively effected. The present invention first and second pedestals; in contrast, promote uniform cooling air distribution.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 6 is a diagrammatic view of a portion of the first and second cavity portions and channel disposed therebetween, illustrating a second embodiment of raised features.

FIG. 7 is an end view of the view shown in FIG. 6.

FIG. 8 is a perspective view of a damper embodiment.

BEST MODE FOR CARRYING OUT THE INVENTION

Figure 1:
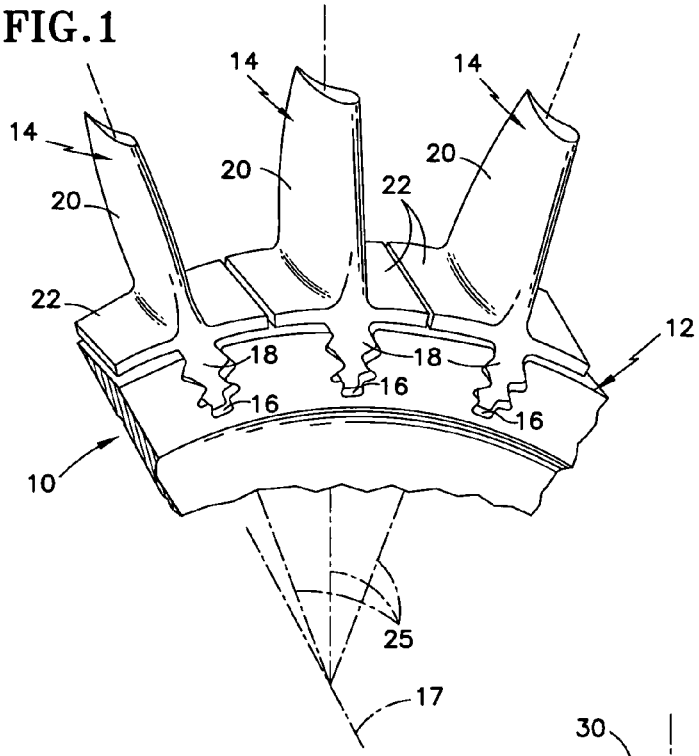
FIG. 1 is a partial perspective view of a rotor assembly.
Figure 2:
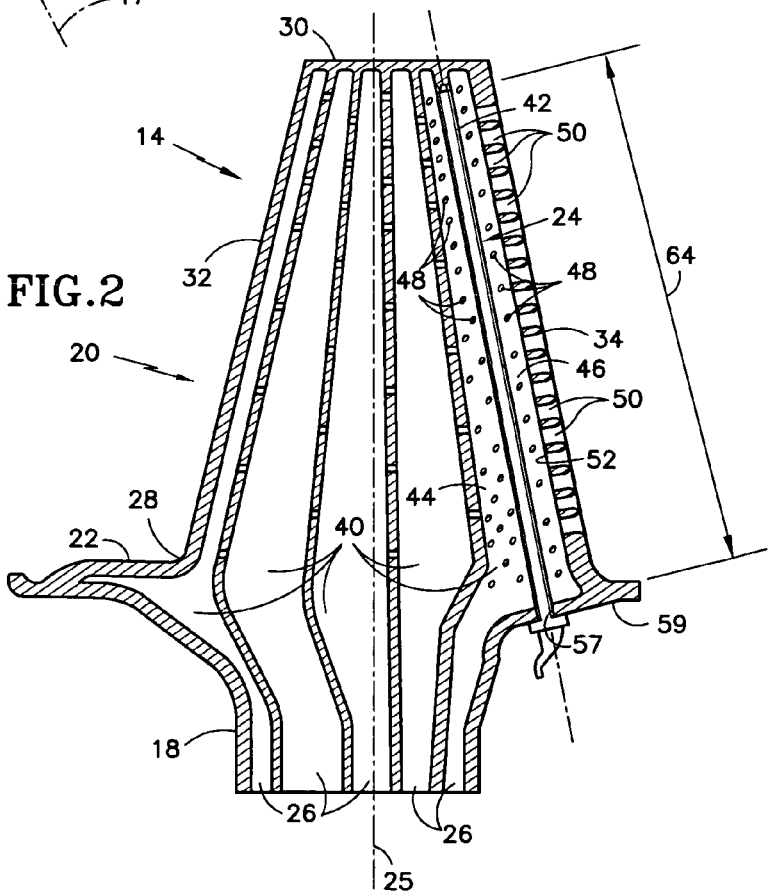
FIG. 2 is a diagrammatic sectioned rotor blade.

Referring to FIG. 1, a rotor blade assembly 10 for a gas turbine engine is provided having a disk 12 and a plurality of rotor blades 14. The disk 12 includes a plurality of recesses 16 circumferentially disposed around the disk 12 and a rotational centerline 17 about which the disk 12 may rotate. Each blade 14 includes a root 18, an airfoil 20, a platform 22, and a damper 24 (see FIG. 2). Each blade 14 also includes a radial centerline 25 passing through the blade 14, perpendicular to the rotational centerline 17 of the disk 12. The root 18 includes a geometry that mates with that of one of the recesses 16 within the disk 12. A fir tree configuration is commonly known and may be used in this instance. As can be seen in FIG. 2, the root 18 further includes conduits 26 through which cooling air may enter the root 18 and pass through into the airfoil 20.

Figure 3:
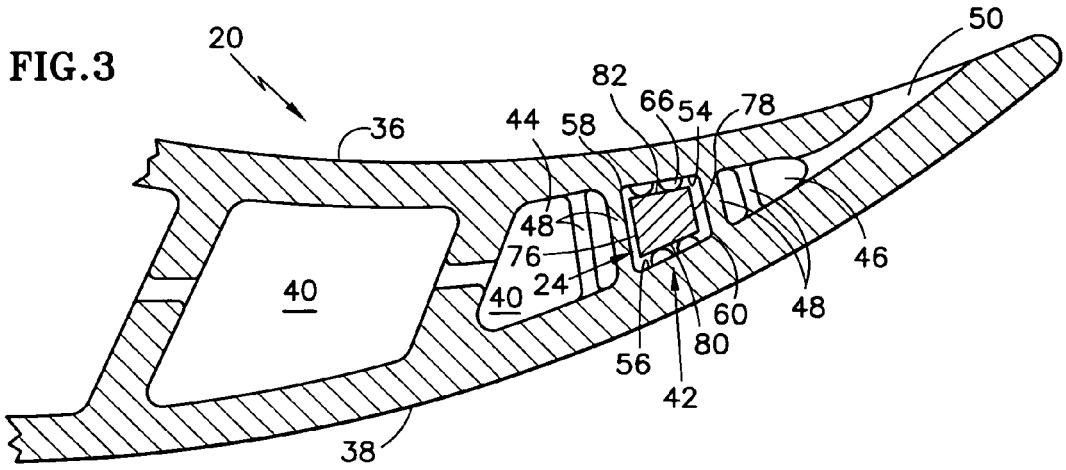
FIG. 3 is a diagrammatic section of a rotor blade portion.
Figure 4:
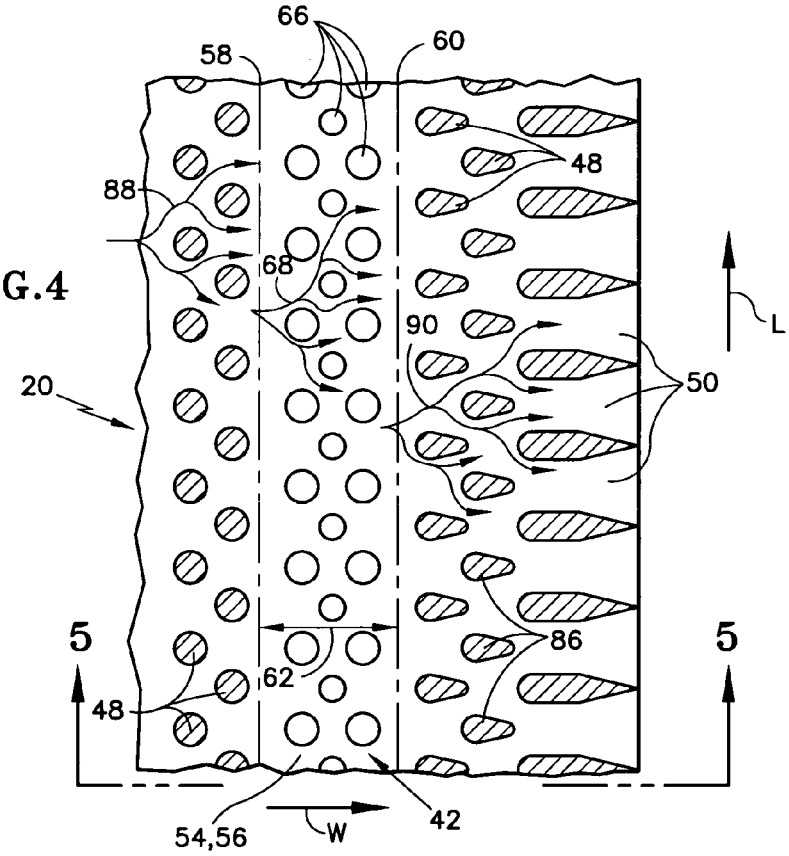
FIG. 4 is a diagrammatic view of a portion of the first and second cavity portions and channel disposed therebetween, illustrating a first embodiment of raised features.
Figure 5:
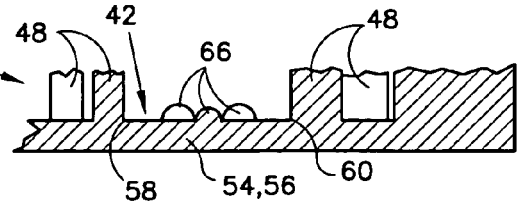
FIG. 5 is an end view of the view shown in FIG. 4.

Referring to FIGS. 1–3, the airfoil 20 includes a base 28, a tip 30, a leading edge 32, a trailing edge 34, a pressure side wall 36, a suction side wall 38, a cavity 40 disposed therebetween, and a channel 42. FIG. 2 diagrammatically illustrates an airfoil 20 sectioned between the leading edge 32 and the trailing edge 34. The pressure side wall 36 and the suction side wall 38 extend between the base 28 and the tip 30 and meet at the leading edge 32 and the trailing edge 34. The cavity 40 can be described as having a first cavity portion 44 forward of the channel 42 and a second cavity portion 46 aft of the channel 42. In an embodiment where an airfoil 20 includes a single cavity 40, the channel 42 is disposed between portions of the one cavity 40. In an embodiment where an airfoil 20 includes more than one cavity 40, the channel 42 may be disposed between adjacent cavities. To facilitate the description herein, the channel 42 will be described herein as being disposed between a first cavity portion 44 and a second cavity portion 46, but is intended to include multiple cavity and single cavity airfoils 20 unless otherwise noted. In the embodiment shown in FIGS. 2–7, the second cavity portion 46 is proximate the trailing edge 34, and both the first cavity portion 44 and the second cavity portion 46 include a plurality of pedestals 48 extending between the walls of the airfoil 20. The characteristics of a preferred pedestal arrangement are disclosed below. In alternative embodiments, only one or neither of the cavity portions contain pedestals 48. A plurality of ports 50 are disposed along the aft edge 52 of the second cavity portion 46, providing passages for cooling air to exit the airfoil 20 along the trailing edge 34.

The channel 42 between the first and second cavity portions 44,46 is defined by a first wall portion 54 and a second wall portion 56 that extend lengthwise between the base 28 and the tip 30, substantially the entire distance between the base 28 and tip 30. The channel initiates at an aperture 57 disposed within the root side surface 59 of the platform 22. The channel 42 has a first lengthwise extending edge 58 and a second lengthwise extending edge 60. The first lengthwise extending edge 58 is disposed forward of the second lengthwise extending edge 60. The channel 42 also includes a width 62 that extends substantially perpendicular to the length 64 (i.e., axially), between the first and second lengthwise extending edges 58,60. The channel 42 may extend substantially straight, or it may be arcuately shaped to accommodate an arcuately shaped damper as is shown in FIG. 8. One or both wall portions 54,56 include a plurality of raised features 66 that extend outwardly from the wall into the channel 42. As will be explained below, the raised features 66 may have a geometry that enables them to form a point, line, or area contact with the damper 24, or some combination thereof. Examples of the shapes that a raised feature 66 may assume include, but are not limited to, spherical, cylindrical, conical, or truncated versions thereof, of hybrids thereof. The distance that the raised features 66 extend outwardly into the channel 42 may be uniform or may purposefully vary between raised features 66.

From a thermal perspective, a point contact is distinguished from an area contact by virtue of the point contact being a small enough area that heat transfer from cooling air passing the point contact cools the point contact to the extent that the temperature of the damper 24 and the airfoil wall portion 54,56 at the point contact are not appreciably different from that of the surrounding area. A line contact is distinguished similarly; e.g., a line contact is distinguished from an area contact by virtue of the line contact being a small enough area that heat transfer from cooling air passing the line contact cools the line contact to the extent that the temperature of the damper 24 and the airfoil wall portion 54,56 at the line contact is not appreciably different from that of the surrounding area.

From a damping perspective, a point contact is distinguished from an area contact by virtue of the magnitude of the load transmitted through the point contact versus through an area contact. Regardless of the size of the contact, the load for a given set of operating conditions will be the same and it will be distributed as a function of force per unit area. In the case of a plurality of point contacts, the load will be substantially higher per unit area than it would be for a much larger area contact relatively speaking. A line contact is distinguished similarly; e.g., a line contact is distinguished from an area contact by virtue of the line contact having a substantially higher per unit area than it would be for a much larger area contact relatively speaking.

Referring to FIGS. 4–7, the size and the arrangement of the raised features 66 within the channel 42 relative to the size of the channel 42 are such that tortuous flow passages 68 are created across the width of the channel 42. As a result, cooling air flow entering the channel 42 across the first lengthwise extending edge 58 encounters and passes a plurality of raised features 66 within the channel 42 prior to exiting the channel 42 across the second lengthwise extending edge 60. The directional components of the cooling air flow within the tortuous flow passages 68 are discussed below. The raised features 66 within the channel 42 may be arranged randomly and still form the aforesaid tortuous flow passages 68 across the width of the channel 42. The raised features 66 may also be arranged into rows, wherein the raised features 66 within one row are offset from the raised features 66 of an adjacent row to create the aforesaid tortuous flow path 68 between the pedestals 48.

With respect to the directional components of the cooling air flow within the tortuous flow passages 68, substantially all of the tortuous flow passages 68 include at least one portion that extends at least partially in a lengthwise direction (shown as arrow "L") and at least one portion that extends at least partially in a widthwise direction (shown as arrow "W"). The tortuous flow passages 68 desirably facilitate heat transfer between the damper 24 and the cooling air, and between the airfoil wall portion 54,56 and the cooling air, for several reasons. For example, cooling air passing through the tortuous flow passages 68 has a longer dwell time between the damper 24 and the airfoil wall portion 54,56 than cooling air typically would in a widthwise extending slot. Also, the surface area of the damper 24 and the airfoil 20 exposed to the cooling air within the tortuous flow passages 68 is increased relative to that typically exposed within a prior art damper arrangement having widthwise extending slots. These cooling advantages are not available to damper having only widthwise extending slots and area contacts therebetween.

Referring to FIGS. 3 and 8, the damper 24 includes a head 70 and a body 72. The body 72 includes a length 74, a forward face 76, an aft face 78, and a pair of bearing surfaces 80,82. The head 70, fixed to one end of the body 72, may contain a seal surface 84 for sealing between the head 70 and the blade 14. The body 72 is typically shaped in cross-section to mate with the cross-sectional shape of the channel 42. For example, a damper 24 having a trapezoidal cross-sectional shape is preferably used with a channel 42 having trapezoidal cross-sectional shape. The cross-sectional area of the damper 24 may change along its length 74 to mate with the cross-sectional shape of the channel 42 portion aligned therewith when the damper 24 is installed within the channel 42. The bearing surfaces 80,82 extend between the forward face 76 and the aft face 78, and along the length 74 of the body 72.

Referring to FIGS. 2–7, in preferred embodiments the first cavity portion 44 and the second cavity portion 46 include a plurality of pedestals 48 extending between the walls of the airfoil 20, proximate the channel 42. The pedestals 48, located within the first cavity portion 44 adjacent the first lengthwise extending edge of the channel 42, are shown in FIGS. 2–5 as substantially cylindrical in shape. Other pedestal 48 shapes may be used alternatively. The plurality of pedestals 48 within the first cavity portion 44 are preferably arranged in an array having a plurality of rows offset from one another to create a tortuous flow path 88 between the pedestals 48. The tortuous flow path 88 improves local heat transfer and promotes uniform flow distribution for the cooling air entering the channel 42 across the first lengthwise extending edge 58. The pedestal array can be disposed along a portion or all of the length of the channel 42.

The pedestals 48 within the second cavity portion 46 may assume a variety of different shapes; e.g., cylindrical, oval, etc., and are located adjacent the second lengthwise extending edge 60 of the channel 42. In the embodiments shown in FIGS. 4–7, each pedestal 48 includes a convergent portion 86 that extends out in an aftward direction; e.g., a tapered pedestal 48 with the convergent portion 86 of the pedestal oriented toward the trailing edge 34. The tapered pedestal feature allows for a significant reduction in the downstream wake emanating from the smaller trailing edge diameter 96 primarily resulting from the aerodynamic shape of the feature. The region of separated flow downstream of the tapered pedestal is smaller in size and magnitude allowing the flow to become more uniform prior to entry into the trailing edge port teardrop region. By re-establishing a more uniform coolant flow field downstream of the tapered pedestal, the potential for internal flow separation along the trailing edge port meter and diffused sections of trailing edge teardrop feature are minimized. Fully developed non-separated uniform port flow will ensure the local trailing edge port adiabatic film effectiveness is maximized thereby reducing the suction side lip metal temperature resulting in improved thermal performance.

The pedestals 48 within the second cavity portion 46 may assume a variety of different shapes; e.g., cylindrical, oval, etc., and are located adjacent the second lengthwise extending edge 60 of the channel 42. In the embodiments shown in FIGS. 4–7, each pedestal 48 includes a convergent portion 86 that extends out in an aftward direction; e.g., a tapered pedestal 48 with the convergent portion 86 of the pedestal oriented toward the trailing edge 34. The tapered pedestal 48 allows for a significant reduction in the downstream wake emanating from the smaller trailing edge diameter 96 primarily resulting from the aerodynamic shape of the feature. The region of separated flow downstream of the tapered pedestal 48 is smaller in size and magnitude allowing the flow to become more uniform prior to entry into the trailing edge port 50 diffusion region. By re-establishing a more uniform coolant flow field downstream of the tapered pedestal 48, the potential for internal flow separation along the meter and diffused sections of trailing edge ports are minimized. Fully developed non-separated uniform port flow will ensure the local trailing edge port adiabatic film effectiveness is maximized thereby reducing the suction side lip metal temperature resulting in improved thermal performance.

The implementation of tapered pedestals 48 also allows for tighter row to row spacing (shown by arrow 98). The tighter row to row spacing, in turn, enables more internal convective surface area without compromising overall flow area, spacing, and blockage criteria currently established for more conventional circular pedestal design features. The tapered pedestals 48 are preferably staggered one half pitch relative to the trailing edge pedestals 100. Pitch refers to the distance between adjacent pedestals 48,100 within a particular row. The impingement characteristics and resulting high internal convective heat transfer coefficients typically achieved on the leading edge of the pedestals 48 are not adversely impacted by the inclusion of the convergent portions 86. The overall trailing edge thermal cooling efficiency is, however, significantly increased as a result of the increased convective area attributed to the tapered pedestal design. The plurality of pedestals 48 within the second cavity portion 46 are preferably arranged in an array having a plurality of rows offset from one another to create a tortuous flow path 90 between the pedestals 48. The tortuous flow path 90 improves local heat transfer and promotes uniform flow distribution for the cooling air exiting the channel 42 across the second lengthwise extending edge 60. The pedestal array can be disposed along a portion or all of the length of the channel 42. The aft-most row is located so that the pedestals 48 contained therein are aligned relative to the cooling features of the trailing edge 34. For example, the pedestals 48 within the aft-most row shown in FIGS. 4–7 are aligned with the ports 50 disposed along the trailing edge 34.

The plurality of pedestals 48 within the second cavity portion 46 are preferably arranged in an array having a plurality of rows offset from one another to create a tortuous flow path 90 between the pedestals 48. The tortuous flow path 90 improves local heat transfer and promotes uniform flow distribution for the cooling air exiting the channel 42 across the second lengthwise extending edge 60. The pedestal array can be disposed along a portion or all of the length of the channel 42. The aft-most row is located so that the pedestals 48 contained therein are aligned relative to the cooling features of the trailing edge 34. For example, the pedestals 48 within the aft-most row shown in FIGS. 4–7 are aligned with the ports 50 disposed along the trailing edge 34.

Referring to FIGS. 1–8, under steady-state operating conditions, a rotor blade assembly 10 within a gas turbine engine rotates through core gas flow passing through the engine. The high temperature core gas flow impinges on the blades 14 of the rotor blade assembly 10 and transfers a considerable amount of thermal energy to each blade 14, usually in a non-uniform manner. To dissipate some of the thermal energy, cooling air is passed into the conduits 26 within the root 18 of each blade. From there, a portion of the cooling air passes into the first cavity portion 44 where pressure differences direct it toward and into the array of pedestals 48 adjacent the first lengthwise extending edge 58 of the channel 42. From there the cooling air crosses the first lengthwise extending edge 58 of the channel 42 are enters the tortuous flow passages 68 formed between the airfoil wall portion 54,56, the damper 24, and pedestals 48 extending therebetween. Substantially all of the tortuous flow passages 68 include at least a portion that extends at least partially in a lengthwise direction and at least a portion that extends at least partially in a widthwise direction. As a result, cooling air within the tortuous flow passages 68 distributes lengthwise as it travels across the width of the damper 24. Once the cooling air has traveled across the width of the damper 24, it exits the passages 68, crosses the second lengthwise extending edge 60 of the channel 42, and enters the array of pedestals 48 adjacent the second lengthwise extending edge 60 of the channel 42. Once the flow passes through the array of pedestals 48 adjacent the second lengthwise extending edge 60 of the channel 42, it exits the ports 50 disposed along the trailing edge 34 of the airfoil 20.

The bearing surfaces 80,82 of the damper 24 contact the raised features 66 extending out from the wall portions 54,56 of the channel 42. Depending upon the internal characteristics of the airfoil 20, the damper 24 may be forced into contact with the raised features 66 by a pressure difference across the channel 42. A contact force is further effectuated by centrifugal forces acting on the damper 24, created as the disk 12 of the rotor blade assembly 10 is rotated about its rotational centerline 17. The skew of the channel 42 relative to the radial centerline of the blade 25, and the damper 24 received within the channel 42, causes a component of the centrifugal force acting on the damper 24 to act in the direction of the wall portions 54,56 of the channel 42; i.e., the centrifugal force component acts as a normal force against the damper 24 in the direction of the wall portions 54,56 of the channel 42.

Although this invention has been shown and described with respect to the detailed embodiments thereof, it will be understood by those skilled in the art that various changes in form and detail thereof may be made without departing from the spirit and the scope of the invention.

What is claimed is:

1. A rotor blade for a rotor assembly, comprising:

a root;

an airfoil, having a base, a tip, a pressure side wall, a suction side wall, and a cavity disposed between the side walls, wherein the cavity extends substantially between the base and the tip and includes a first cavity portion and a second cavity portion, and a channel disposed between the first cavity portion and the second cavity portion;

wherein a plurality of first pedestals are disposed within the first cavity portion adjacent the channel, and a plurality of second pedestals are disposed within the second cavity portion adjacent the channel; and a damper, selectively received within the channel.

2. The rotor blade of claim 1, wherein the plurality of first pedestals are arranged to form a tortuous flow path for cooling air entering the channel.

3. The rotor blade of claim 2, wherein the plurality of first pedestals are randomly arranged.

4. The rotor blade of claim 2, wherein the plurality of first pedestals are arranged in a plurality of rows, and the first pedestals within each row are positioned offset from the first pedestals within an adjacent row of first pedestals.

5. The rotor blade of claim 1, wherein the plurality of second pedestals are arranged to form a tortuous flow path for cooling air exiting the channel.

6. The rotor blade of claim 5, wherein the plurality of second pedestals are randomly arranged.

7. The rotor blade of claim 5, wherein the plurality of second pedestals are arranged in a plurality of rows, and the second pedestals within each row are positioned offset from the second pedestals within an adjacent row of second pedestals.

8. The rotor blade of claim 1, wherein the airfoil further comprises a leading edge and a trailing edge, wherein the plurality of second pedestals are disposed between the channel and the trailing edge.

9. The rotor blade of claim 8, wherein each of the plurality of second pedestals includes a convergent portion that extends outwardly in an aftward direction.

10. The rotor blade of claim 1, wherein the rotor blade further includes a platform disposed between the airfoil and the root.

11. The rotor blade of claim 10, wherein the channel extends from an aperture in the platform into the cavity of the airfoil.

12. The rotor blade of claim 11, wherein the channel extends substantially from the platform to the tip of the airfoil.

13. The rotor blade of claim 12, wherein the channel follows an arcuately shaped path.

14. The rotor blade of claim 1, wherein the plurality of first pedestals and the plurality of second pedestals are positioned relative to the channel to maintain the damper within the channel.

15. The rotor blade of claim 14, wherein the channel follows an arcuately shaped path.

* * * * *